US006196831B1

(12) United States Patent
Dugue et al.

(10) Patent No.: US 6,196,831 B1
(45) Date of Patent: Mar. 6, 2001

(54) COMBUSTION PROCESS FOR BURNING A FUEL

(75) Inventors: Jacques Dugue, Montigny le Bretonneux; Jean-Michel Samaniego; Bernard Labegorre, both of Paris, all of (FR); Olivier Charon, Chicago, IL (US)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/388,539

(22) Filed: Sep. 2, 1999

(30) Foreign Application Priority Data

Sep. 2, 1998 (FR) ..... 98 10966

(51) Int. Cl.[7] ..... F23C 5/00

(52) U.S. Cl. ..... 431/8; 431/10; 431/187; 431/190; 239/424; 239/424.5

(58) Field of Search ..... 431/187.8, 10, 431/185, 115, 181, 116, 190, 351, 350; 239/423, 424.5

(56) References Cited

U.S. PATENT DOCUMENTS 4,439,137 * 3/1984 Suzuki et al. ..... 431/8
4,541,796 9/1985 Anderson .
5,833,447 * 11/1998 Bodelin et al. ..... 431/8
5,839,890 * 11/1998 Snyder ..... 431/8
5,975,886 * 11/1999 Philippe ..... 431/10

FOREIGN PATENT DOCUMENTS 0 754 912 A2 1/1997 (EP) .
0 844 433 A2 5/1998 (EP) .

* cited by examiner

*Primary Examiner*—James C. Yeung
(74) *Attorney, Agent, or Firm*—Burns, Doane, Swecker & Mathis, LLP

(57) ABSTRACT

The invention relates to a combustion process for burning a fuel, in which the point of injection of each main oxidizer jet (7, 8) with respect to the point of injection of a fuel jet (4) closest to it is arranged a distance D away satisfying the following relation:

$$\frac{D}{\sqrt{A}} > 5 \text{ and/or } \frac{D}{\sqrt{B}} > 5$$

D being the minimum distance between the outer edge of the relevant oxidizer jet (7, 8) and the outer edge of the fuel jet (4) closest to it, at their respective points of injection, A and B being, respectively, the cross section of the main jet (7, 8) of the oxidizer and the cross section of the fuel jet, considered at their respective points of injection.

13 Claims, 5 Drawing Sheets

COMBUSTION PROCESS FOR BURNING A FUEL

BACKGROUND OF THE INVENTION

1. Field of the Invention

The invention relates to a process for burning a fuel, in which at least one fuel jet and, some distance therefrom, at least one main jet of an oxdizer are injected into a combustion zone.

2. Description of the Related Art

A combustion process is known from U.S. Pat. No. 4,988,285, which makes it possible to reduce the formation of nitrogen oxides of the type $NO_x$, in which a jet of fuel, for example natural gas, and a main jet of an oxidizer, for example air or oxygen-enriched air, arranged a short distance from the fuel jet, preferably between 4 to 20 times the diameter of the main oxidizer jet, are injected into a combustion zone.

The Applicant has however found that such a known combustion process leads to the production of too great a quantity of nitrogen oxides when the fuel and main oxidizer jets are arranged a short distance apart.

When the oxidizer and fuel jets are moved further apart in order to reduce the emission of nitrogen oxides, one is then confronted with problems regarding the stability of sustained combustion (the flame may at times go out) and with the presence of unburnt fuel in the fumes, this also being harmful to the environment.

The invention aims to alleviate these drawbacks by proposing a combustion process making it possible to obtain stable combustion, with low emission of nitrogen oxides, despite the distance between the oxidizer and fuel jets being much greater than that described in the prior art such as U.S. Pat. No. 4,988,285.

SUMMARY OF THE INVENTION

To this end, the subject of the invention is a combustion process for burning a fuel, in which at least one fuel jet and some distance therefrom at least one main jet of an oxidizer are simultaneously injected into a main combustion zone, characterized in that the point of injection of each main oxidizer jet with respect to the point of injection of the fuel jet closest to it is arranged a distance D away satisfying at least one of the following relations:

$$\frac{D}{\sqrt{A}} > 5$$

(and preferably >10) and/or $$\frac{D}{\sqrt{B}} > 5$$

(and preferably >10)

D being defined as the minimum distance between the outer edge of the relevant oxidizer jet and the outer edge of the fuel jet closest to it, at their respective points of injection, and A and B being respectively the cross section of the main jet of the oxidizer and the cross section of the fuel jet, the cross sections being considered at the point of injection of the jets, in such a way as to keep the fuel and main oxidizer jets separated until the said at least one main oxidizer jet and/or the fuel jet has entrained a quantity of a substantially inert surrounding fluid. The quantity of surrounding fluid entrained is preferably greater than five, even more preferably than ten times its own flow rate.

According to a preferred variant, the invention is characterized in that at least one auxiliary jet of an oxidizer is injected into an auxiliary combustion zone situated upstream of the said main combustion zone so as to stabilize the combustion in the said main combustion zone, the point of injection of the said auxiliary oxidizer jet being arranged a distance $D_s$ away from the associated fuel jet, $D_s$ satisfying the following relation:

$$\frac{D_s}{\sqrt{A_s}} < 5$$

$D_s$ being the minimum distance between the outer edge of the relevant auxiliary oxidizer jet and the outer edge of the associated fuel jet, at their respective points of injection, and $A_s$ being the cross section of the relevant auxiliary oxidizer jet at its point of injection, so as to obtain substantially uniform combustion.

The use of a distance D which satisfies at least one of the above two relations enables the main oxidizer jet and the fuel jet to entrain a quantity of surrounding fluid, in particular a substantially inert one, before they react with one another. By taking as reference as the beginning of their interaction (and at the start of the main combustion zone) the point at which the edges of the main oxidizer jet and the fuel jet meet, for substantially parallel jets, each of the relations implies that the total flow rate contained in the jet is at least 1.8 times the initial flow rate of the entraining jet. The ratio (jet flow rate/initial flow rate) increases as the ratio (density of entraining fluid/density of entrained fluid) decreases. By satisfying each of the two inequalities it is possible to obtain a dilution of each of the fuel and main oxidizer jets. This invention will be implemented with a distance D satisfying at least one of the above relations, preferably satisfying $D/A^{0.5}>10$ and/or $D/B^{0.5}>10$, so that the flow rate of at least one of the jets and preferably of each jet (initial flow rate plus substantially inert surrounding fluid) is at least 3.6 times the initial flow rate of the entraining jet.

According to a preferred embodiment, the process is characterized in that the total flow rate of oxidizer injected by the main and auxiliary oxidizer jets is adjusted to a value above the stoichiometric flow rate of oxidizer required to burn all the fuel injected into the combustion zone by the at least one fuel jet. Likewise preferably, the flow rate of oxidizer injected by the at least one auxiliary jet is adjusted to a value below 30%, preferably between 2% and 15% of the total flow rate of oxidizer injected into the combustion zone.

The process according to the invention can moreover include one or more of the following characteristics:

- several main oxidizer jets are injected symmetrically about the at least one fuel jet,
- two main oxidizer jets arranged diametrically opposite with respect to at least one central fuel jet are injected into the combustion zone,
- three central fuel jets which are coplanar with the two main oxidizer jets arranged diametrically opposite with respect to the three central fuel jets are injected into the combustion zone,
- at least one jet of a first fuel, in particular natural gas, and at least one jet of a first fuel, in particular natural gas, and at least one jet of a second fuel, in particular fuel oil, are injected into the said combustion zone (the fuel may in all cases be solid, liquid and/or gaseous).

The term "substantially uniform combustion" signifies that a zone of substantially uniform combustion is obtained characterized by a combustion zone volume which is at least doubled with respect to a flame where the fuel and oxidizer jets mix rapidly without prior dilution with combustion products, and a temperature field with low gradients within the volume of the flame, such that, for an oxidizer composed of pure oxygen, the maximum mean temperature is at least 500° C. below the theoretical adiabatic temperature of the fuel/oxidizer mixture.

The total momentum (fuel+combustible)of the fluid jets, referred to as a unit of power (and which will therefore be expressed in Newtons/Megawatts), will preferably be greater than around 3 N/MW, as to obtain satisfactory mixing of the gases (the momentum is defined here as the product of a mass flow rate (kg/s) times a velocity (m/s)).

The table below (referred to a burner power of 1 MW) summarizes the various results obtained with an oxygen/natural gas flame (of 1 MW):

| | OXYGEN | | NATURAL GAS | | TOTAL |
|---|---|---|---|---|---|
| Case | Velocity | Momentum (N) | Velocity (m/s) | Momentum (N) | Momentum (N) |
| 1 | 10 | 0.9 | 50 | 1.1 | 2.0 |
| 2 | 10 | 0.9 | 100 | 2.2 | 3.1 |
| 3 | 60 | 5.1 | 5 | 0.1 | 5.2 |
| 4 | 100 | 8.5 | 100 | 2.2 | 10.7 |
| 5 | 300 | 25.5 | 400 | 8.8 | 34.3 |

Case 1 corresponds to injection velocities which are very small for the oxidizer and small for the natural gas. Practice shows that the flames produced are sensitive to buoyancy forces and may create hotspots on the roof of an oven, owing to the raising of the rear part of the flame. Cases 2 to 5 show various examples where the mixing of the gases is ensured by momentum supplied either by the oxidizer jets, or by the fuel jets, or by both.

The term substantially inert surrounding fluid signifies the fluid (in general a gas) situated in proximity to the main oxidizer jet. In general, it consists of the combustion gases which recirculate throughout the combustion zone as well as in the vicinity of the injections of combustive and combustible fluids, these combustion gases being more or less diluted by the air present in this combustion zone, in which air there generally remain only the inert species (nitrogen, argon) which have not reacted with the fuel.

BRIEF DESCRIPTION OF THE FIGURES OF THE DRAWINGS

Other characteristics and advantages of the invention will become apparent from the following description given by way of example, without limitation, with regard to the appended drawings in which.

DETAILED DESCRIPTION OF THE PREFERRED EMBODIMENTS

Figure 1:
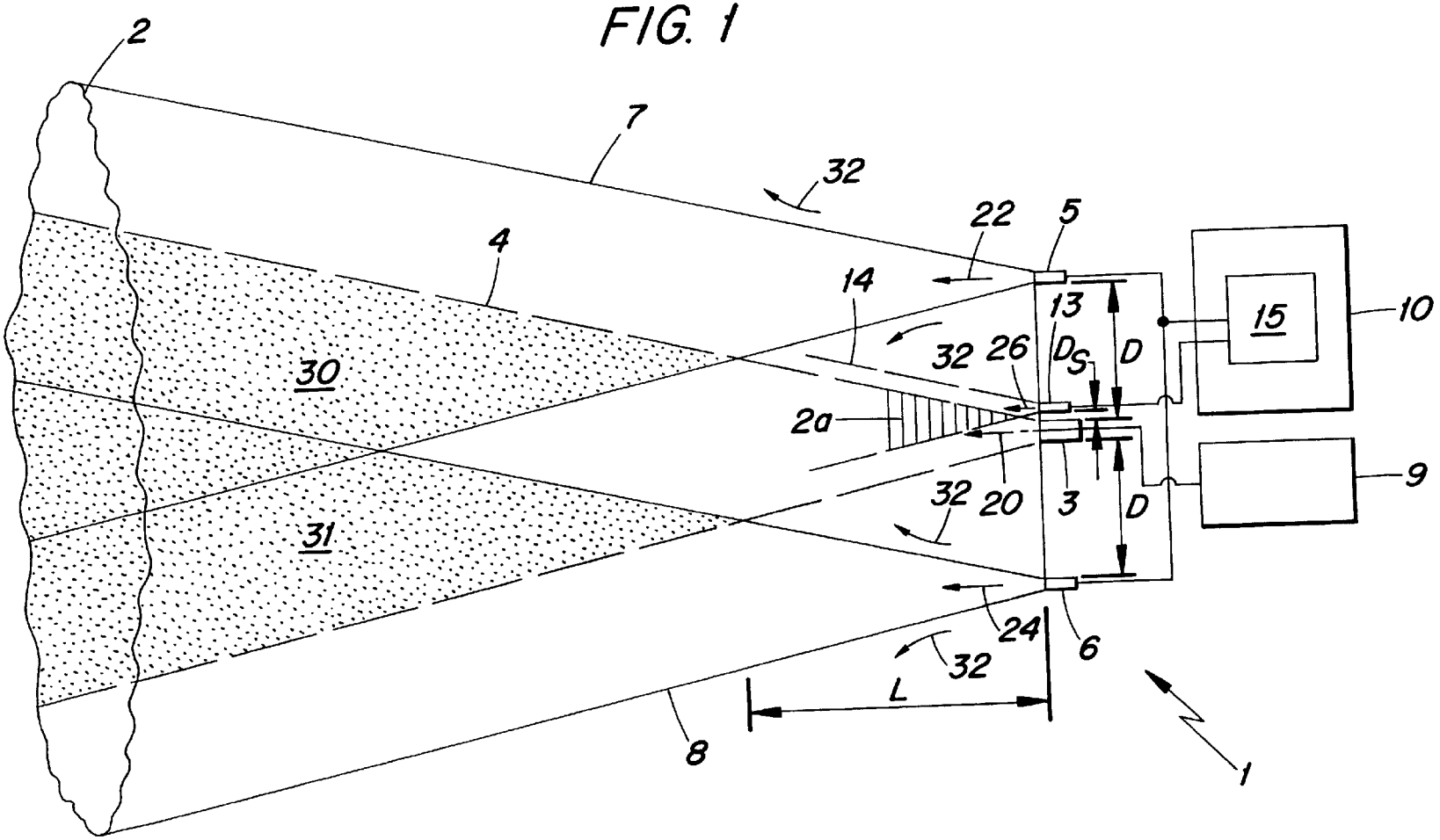
FIG. 1 is a diagram of a combustion installation for implementing the combustion process according to the invention.
Figure 2:
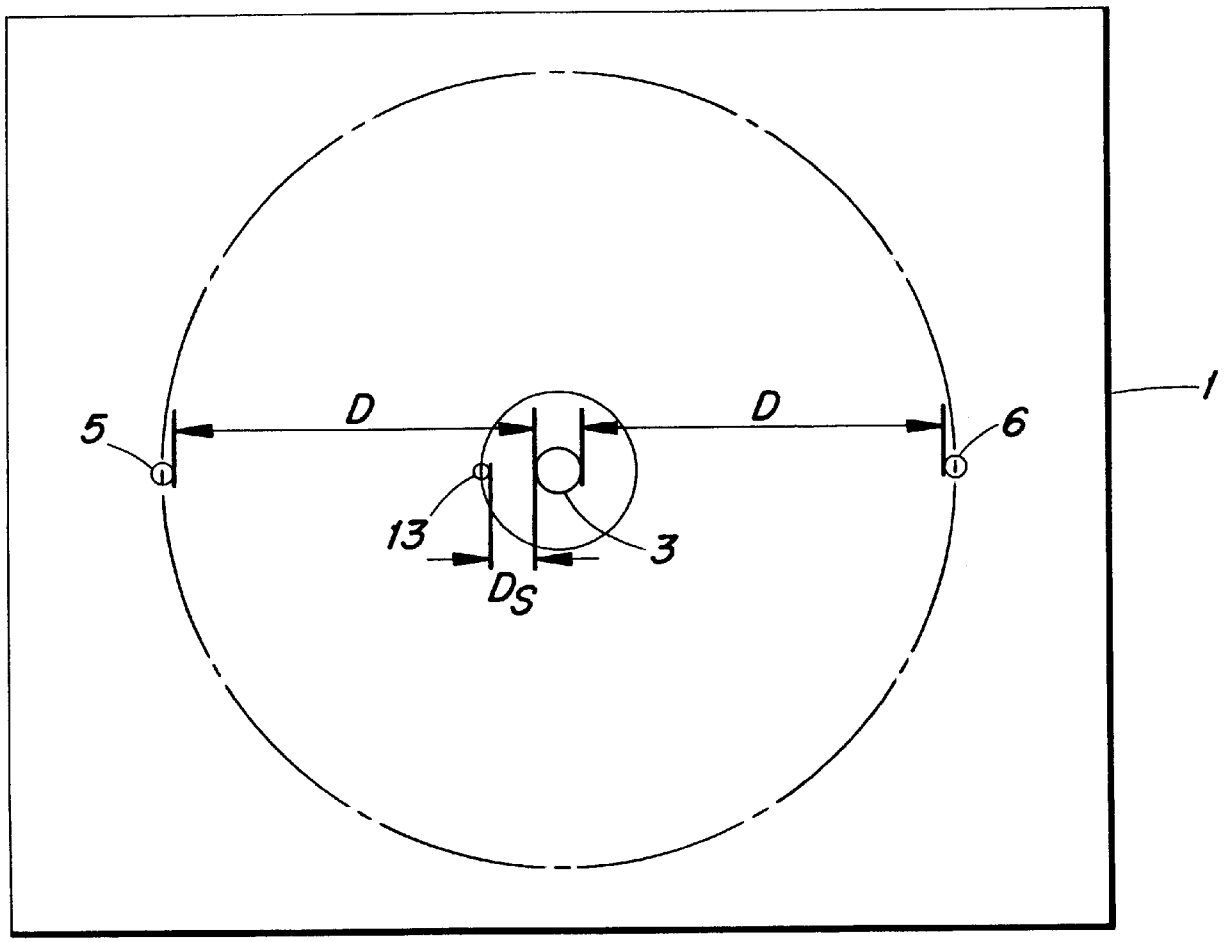
FIG. 2 is diagram of the front view of the installation of FIG. 1.

FIGS. 1 and 2 illustrate a first embodiment of a combustion installation for implementing the process according to the invention.

With reference to these FIGS. 1 and 2, the installation 1 comprises, in order to kindle or sustain a combustion in a main combustion zone 2, on the one hand an injector 3 of a central fuel jet 4 (represented dashed) , such as for example a jet of natural gas, and on the other hand two identical injectors 5 and 6 of main jets of an oxidizer 7 and 8 (represented with solid lines), for example air possibly oxygen-enriched, or pure oxygen, which are arranged diametrically opposite with respect to the injector 3 of the central fuel jet 4.

For their respective feeding, the injector 3 is linked to a fuel supply 9 and the injectors 5 and 6 to an oxidizer supply 10.

Moreover, to stabilize the flame and/or facilitate the start-up of the installation 1, the latter furthermore comprises an injector 13 of an auxiliary oxidizer jet 14 (represented by chain-dotted lines) in an auxiliary combustion zone 2A (represented by hatched lines) situated upstream of the main combustion zone 2. As may be seen in the Figure, the auxiliary jet 14 is arranged in proximity to the injector 3 of the central fuel jet 4 and associated therewith. The injector 13 is likewise fed from the oxidizer supply 10.

In order to be able to easily control the total flow rate of oxygen injected by the main 7, 8 and auxiliary 14 oxidizer jets into the combustion zone 2 and into the auxiliary combustion zone 2A respectively, the oxidizer supply 10 comprises, linked to the oxidizer injectors 5, 6 and 13, means 15 for splitting the total injected flow rate of oxidizer into a first fraction supplying the injectors 5 and 6 of the main oxidizer jets 7 and 8 and a second fraction, complementary to the first, supplying the injector 13 of the auxiliary oxidizer jet 14.

These splitting means 15 may for example consist of a pipe branching off from an oxidizer main supply line of the supply 10 and in which is arranged a valve for adjusting the fraction of the total flow rate of the oxidizer supplying the auxiliary injector 13.

As may be seen in FIG. 2, the various injectors 3, 5, 6 and 13 possess for example circular exit orifices so as to form conical jets which widen out in their respective directions of projection indicated by arrows 20, 22, 24 and 26 in FIG. 1. However, other shapes of exit orifices may also be envisaged, such as for example orifices in the shape of a slit, an ellipse, an annulus or other, so as to modify the shape of the jets.

When the process according to the invention is implemented, the central fuel jet 4 and, some distance therefrom as well as diametrically opposite with respect thereto, the two main oxidizer jets 7 and 8 are injected into the main combustion zone 2 simultaneously. The total flow rate of oxidizer injected by the main 7 and 8 and auxiliary 14 oxidixer jets is adjusted so that it is above the stoichiometric flow rate of oxidizer required to burn all of the fuel injected into the combustion zone 2 so as to achieve complete combustion, that is to say combustion which produces practically no unburnt fuel.

Advantageously, in the stable operating regime, the flow rate of oxidizer injected by the auxiliary oxidizer jet is adjusted to a value below 30%, preferably between 2% and 15% of the total flow rate of oxidizer injected into the combustion zone.

The central fuel jet 4 is preferably injected with a velocity of below 75 m/s while the two main oxidizer jets 7 and 8 are injected at a velocity of preferably between 50 and 150 m/s.

Furthermore, the points of injection defined by the arrangement of the various fuel 3 and oxidizer 5 and 6 injectors are arranged in such a way that the distance D between the point of injection of each main oxidizer jet 7, 8 satisfies, with respect to the point of injection of the fuel jet 4, the following relation:

$$\frac{D}{\sqrt{A}} > 5 \qquad \text{(I)}$$

In this relation (I), D represents the minimum distance between the outer edge of the relevant oxidizer jet, 7 or 8, and the outer edge of the fuel jet 4 at their respective points of injection (see FIG. 2), and A represents the cross section of the main jet of the relevant oxidizer 7 or 8 at its point of injection.

Thus, the oxidizer jets 7 and 8 and fuel jet 4 begin to mix only onwards of a distance L from the respective points of injection, in mixing zones 30, 31 represented shaded. Separating the jets over this distance L enables them, in particular the main oxidizer jets 7 and 8, to entrain a sizeable quantity of the substantially inert surrounding fluid, as is represented by arrows 32 in FIG. 1. This entrained quantity of the surrounding fluid is generally greater than 5, preferably than 10 times the flow rate of the jet entraining this fluid. In the case where the jets are injected into a closed combustion chamber, this surrounding fluid is composed mainly of combustion products.

Because the surrounding fluid does not participate actively in the combustion and by virtue of the sizeable quantity of this fluid entrained, the oxidizer/fuel mixture is diluted in the mixing zones 30 and 31 and the volume occupied by the main combustion zone 2 is enlarged. The effect of this is to make the spatial distribution of the temperature field in this main combustion zone 2 uniform and to decrease the mean temperature therein, so that the emission of nitrogen oxides is effectively reduced.

To further optimize the conditions of combustion, the distance D furthermore satisfies the following relation:

$$\frac{D}{\sqrt{A_c}} > 5 \qquad \text{(II)}$$

where $A_c$ represents the cross section of the fuel jet at its point of injection.

To start up and subsequently stabilize the combustion, the auxiliary oxidizer jet 14 is moreover injected into the main combustion zone 2, some distance $D_s$ from the associated fuel jet 4. The combustion in the main zone 2 is stabilized through the presence of the auxiliary combustion zone 2A upstream, which thus ensures a region of stable ignition of the oxidizer/fuel mixture in the zone 2. $D_s$ satisfies the following relation:

$$\frac{D_s}{\sqrt{A_s}} < 5 \qquad \text{(III)}$$

In this relation (III), $D_s$ represents the minimum distance between the outer edge of the relevant auxiliary oxidizer jet 14 and the outer edge of the associated fuel jet 4, at their respective points of injection, and $A_s$ represents the cross section of the auxiliary oxidizer jet 14 at its point of injection.

Of course, in all these relations, the cross sections A, $A_c$, and $A_s$ of the jets at their respective points of injection are determined by taking their particular geometrical shapes into account.

In particular, if for example the size of the cross section of one of the main oxidizer jets is greater than that of the other, the minimum distances D between the outer edges of the respective oxidizer and fuel jets may also be different, namely an oxidizer jet having a smaller cross section may be arranged nearer to the fuel jet than one having a larger cross section.

Moreover, it is possible to envisage several injectors of fuel jets and several injectors of main oxidizer jets. In this case, to satisfy relation (I), it is necessary to consider, for each main oxidizer jet, the fuel jet closest to it.

In a minimal configuration of the invention, only one fuel jet, one main oxidizer jet and one auxiliary oxidizer jet are envisaged, the arrangement of the jets satisfying relations (I), (II) and (III).

Figure 3:
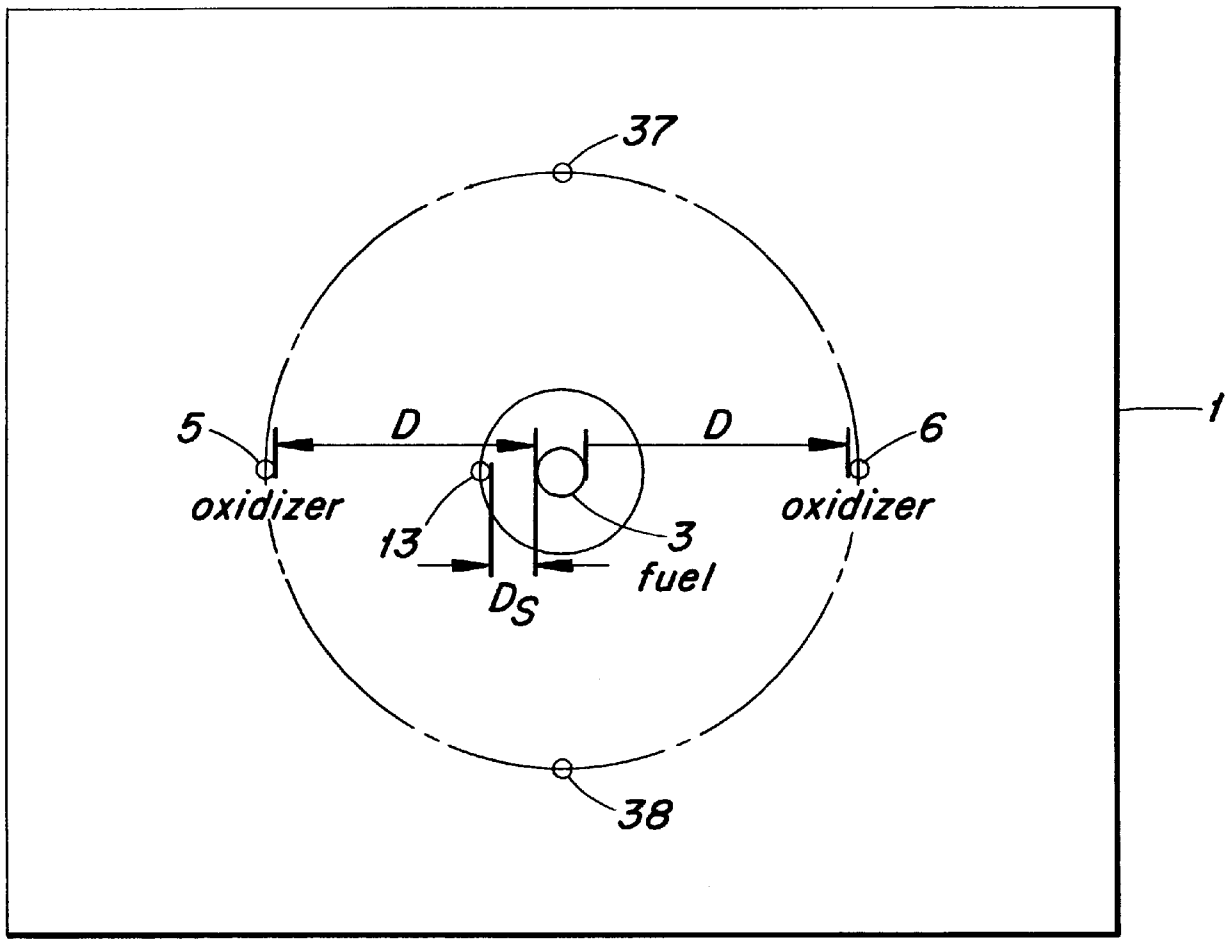
FIG. 3 is a diagram according to a view identical to that of FIG. 2 of a first variant of a combustion installation to illustrate a development of the process according to the invention.

As a variant of the installation of FIGS. 1 and 2 and as represented in FIG. 3, it is for example possible to envisage two supplementary injectors 37 and 38 of main oxidizer jets. These injectors 37 and 38 as well as the injectors 5 and 6 are arranged symmetrically about the injector 3 of the central fuel jet 4. Such a configuration makes it possible to produce a more compact combustion installation since it is possible to choose main oxidizer injectors of reduced diameter, arranged nearer to the fuel injector whilst satisfying relation (I).

Figure 4:
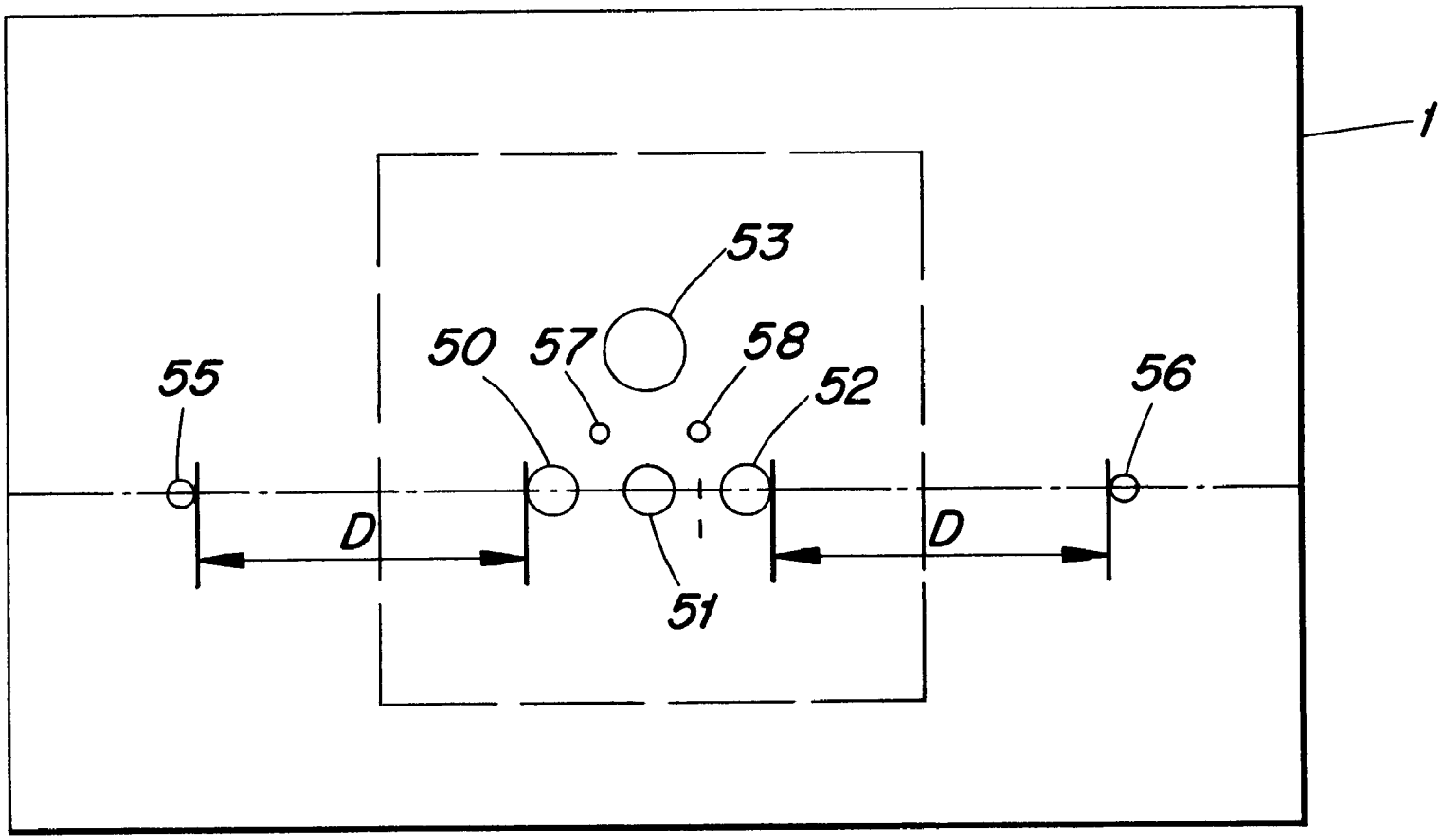
FIG. 4 is a diagram according to a view identical to that of FIG. 2 of a second variant of a combustion installation to illustrate another development of the process according to the invention.

FIG. 4 shows a front view identical to that of FIG. 2 of another variant of an installation 1 for implementing the process according to the invention.

The installation of this variant comprises three injectors 50, 51 and 52 of three jets of a first fuel, for example natural gas, which are coplanar with injectors 55 and 56 of main oxidizer jets arranged diametrically opposite with respect to the injectors 50, 51 and 52, and an injector 53 of a jet of a second fuel, for example fuel oil, arranged above the three injectors 50, 51 and 52 of the jets of the first fuel and making it possible to alternate the fuel used.

Of course, the injectors 55 and 56 and consequently the main oxidizer jets projected into the combustion zone by them are located, at their respective points of injection, with a minimum distance D between the outer edges with respect to the closest fuel jet, that is to say the jet projected by the injector 50 as regards the main injector 55 and the injector 52 as regards the main injector 56, so as to comply with relations (I) and (II).

Additionally, two injectors 57 and 58 of auxiliary oxidizer jets are arranged above the three injectors 50, 51 and 52 of the fuel jets, one 57 of which is associated with the injectors 50, 51 and 53 and the other 58 of which is associated with the injectors 51, 52 and 53. These auxiliary injectors 57 and 58 are located with a minimum distance $D_s$ between the outer edges of the fuel jets so as to comply with relation (III).

Of course, in all the variants represented in FIGS. 1 to 4 it is also possible to imagine inverting the supply to the injectors so that oxidizer jets are injected instead of the fuel jets and vice versa provided that relations (I), (II) and (III) are complied with.

Figure 5:
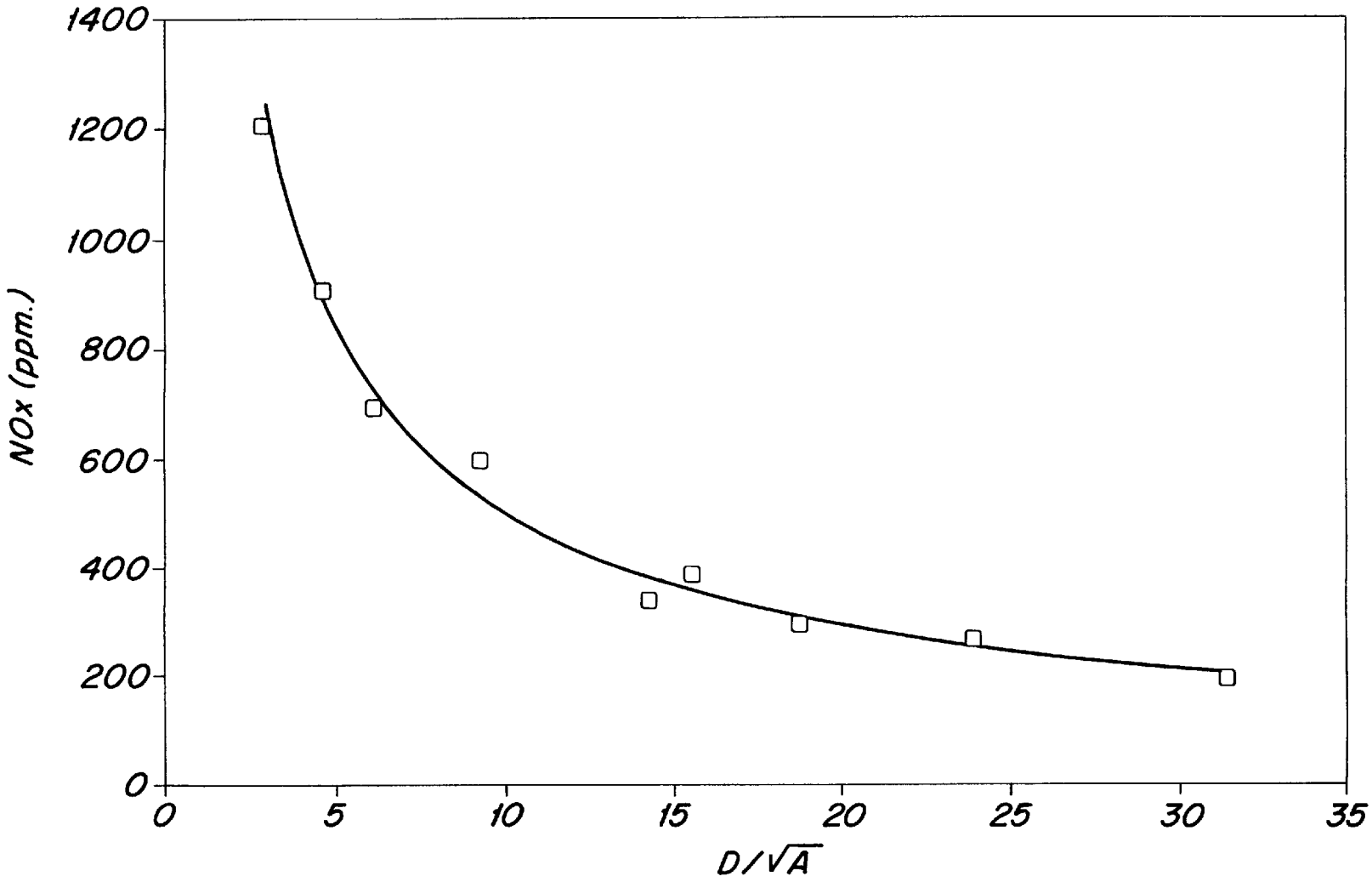
FIG. 5 is a graph showing the emission of nitrogen oxides from an installation implementing the process according to the invention.

FIG. 5 shows by way of example a graph representing a result obtained with the process according to the invention implemented with the aid of an installation of the type represented in FIGS. 1 and 2 and in which it is possible to alter the distance D defined above of the main oxidizer jets with respect to the central fuel jet. This graph shows the quantity of nitrogen oxides ($NO_x$) produced during combustion as a function of the parameter D/√A defined above.

In this graph it may be seen that the formation of the nitrogen oxides decreases considerably as a function of the parameter D/√A. It may clearly be seen that for the main oxidizer jets whose arrangement complies with the relation $$\frac{D}{\sqrt{A}} > 5,$$

the reduction in emissions of nitrogen oxides is sizeable.

By virtue of the process according to the invention and in particular of the arrangement of the main and auxiliary oxidizer jets with respect to the fuel injectors, stable combustion and reduced emission of nitrogen oxides are obtained.

What is claimed is:

1. A combustion process for burning a fuel, comprising the steps:

simultaneously injecting at least one fuel jet and at least one main oxidizer jet into a main combustion zone, the point of injection of each at least one main oxidizer jet being a distance D from the point of injection of the fuel jet closest to the at least one main oxidizer jet, the distance D satisfying at least one of the following relations:

$$\frac{D}{\sqrt{A}} > 5$$

and $$\frac{D}{\sqrt{B}} > 5$$

wherein D is the minimum distance between the outer edge of the at least one main oxidizer jet and the outer edge of said closest fuel jet at their respective points of injection, and A and B are the cross sectional area of the at least one main oxidizer jet and the cross sectional area of the at least one fuel jet, the cross sectional areas A and B being taken at each point of injection of the at least one main oxidizer jet and the at least one fuel jet, the injecting step being performed so as to keep the at least one fuel jet and the at least one main oxidizer jet separated until the at lest one main oxidizer jet, the at least one fuel jet, or both, has entrained a quantity of a substantially inert surrounding fluid so as to obtain substantially uniform combustion; and injecting at least one auxiliary oxidizer jet into an auxiliary combustion zone situated upstream of the main combustion zone to stabilize the combustion in the main combustion zone, the point of injection of the at least one auxiliary oxidizer jet being arranged a distance $D_s$ away from the at least one fuel jet, $D_s$ satisfying the following relation:

$$\frac{D_s}{\sqrt{A_s}} < 5$$

$D_s$ being the minimum distance between the outer edge of the at least one auxiliary oxidizer jet and the outer edge of the at least one fuel jet at their respective points of injection, and $A_s$ being the cross sectional area of the at least one auxiliary oxidizer jet at its point of injection.

2. A process according to claim 1, wherein the rate of the quantity of surrounding fluid entrained is greater than five times its own flow rate.

3. A process according to claim 2, wherein the rate of the quantity of surrounding fluid entrained is greater than ten times its own flow rate.

4. A process according to claim 1, wherein the total flow rate of oxidizer injected by the at least one main oxidizer jet and at least one auxiliary oxidizer jet is above the stoichiometric flow rate of oxidizer required to burn all the fuel injected into the combustion zone by the at least one fuel jet.

5. A process according to claim 1, wherein the flow rate of oxidizer injected by the at least one auxiliary jet is adjusted to a value below 30% of the total flow rate of oxidizer injected into the combustion zone.

6. A process according to claim 5, wherein the flow rate of oxidizer injected by the at least one auxiliary jet is adjusted to a value between 2% and 15% of the total flow rate of oxidizer injected into the combustion zone.

7. A process according to claim 1, wherein the total flow rate of oxidizer injected by the at least one main jet and at least one auxiliary oxidizer jet is adjusted to a value above the stoichiometric flow rate of oxidizer required to burn all the fuel injected into the combustion zone by the at least one fuel jet.

8. A process according to claim 1, wherein the step of simultaneously injecting comprises simultaneously injecting with a plurality of main oxidizer jets symmetrically about the at least one fuel jet.

9. A process according to claim 8, wherein the at least one main oxidizer jet comprises two main oxidizer jets arranged diametrically opposite with respect to the at least one fuel jet, and wherein the step of simultaneously injecting comprises simultaneously injecting the two main oxidizer jets into the combustion zone.

10. A process according to claim 9, wherein the at least one fuel jet comprises three central fuel jets which are coplanar with the two main oxidizer jets, the two main oxidizer jets being arranged diametrically opposite each other on different sides of the three central fuel jets, and wherein the step of simultaneously injecting comprises simultaneously injecting the two main oxidizer jets into the combustion zone.

11. A process according to claim 1, further comprising:

injecting at least one jet of a first fuel and at least one jet of a second fuel into the combustion zone.

12. A process according to claim 11, wherein the first fuel is natural gas and the second fuel is fuel oil.

13. A process in accordance with claim 1, wherein D satisfies at least one of the following relations:

$$\frac{D}{\sqrt{A}} > 10 \text{ and } \frac{D}{\sqrt{B}} > 10.$$

* * * * *